US011331556B1

(12) United States Patent
Hethcock, Jr.

(10) Patent No.: US 11,331,556 B1
(45) Date of Patent: May 17, 2022

(54) GOLF PUTTING TRAINING AID

(71) Applicant: James Donn Hethcock, Jr., Colleyville, TX (US)

(72) Inventor: James Donn Hethcock, Jr., Colleyville, TX (US)

( * ) Notice: Subject to any disclaimer, the term of this patent is extended or adjusted under 35 U.S.C. 154(b) by 0 days.

(21) Appl. No.: 17/202,315

(22) Filed: Mar. 15, 2021

Related U.S. Application Data

(63) Continuation-in-part of application No. 16/266,062, filed on Feb. 2, 2019, now Pat. No. 10,974,115.

(51) Int. Cl.
*A63B 69/36* (2006.01)
*A63B 69/00* (2006.01)

(52) U.S. Cl.
CPC ..... *A63B 69/3685* (2013.01); *A63B 69/0059* (2013.01); *A63B 69/36211* (2020.08)

(58) Field of Classification Search
CPC ..... A63B 69/3685; A63B 69/36211; A63B 69/0059
USPC ..... 473/207, 215, 216, 219, 223, 227, 229, 473/266, 277, 458
See application file for complete search history.

(56) References Cited

U.S. PATENT DOCUMENTS 3,953,035 A * 4/1976 Beckisk ..... A63B 69/3676 473/229
7,074,133 B1 * 7/2006 Jones ..... A63B 69/3621 473/257
7,806,780 B1 * 10/2010 Plunkett ..... A63B 69/36213 473/257
7,883,429 B1 * 2/2011 Chen ..... A63B 69/3667 473/258
7,993,210 B1 * 8/2011 Hatfield ..... A63B 69/36213 473/215
8,298,094 B1 * 10/2012 Chen ..... A63B 69/3621 473/261
8,591,349 B1 * 11/2013 Jones ..... A63B 69/36211 473/229
10,974,115 B1 * 4/2021 Hatfield ..... A63B 69/0059

* cited by examiner

*Primary Examiner* — Nini F Legesse
(74) *Attorney, Agent, or Firm* — Jeffrey Roddy

(57) ABSTRACT

A golfing apparatus for assisting a golfer in putting includes a guide member adapted to encourage only certain motions during the golf swing to improve the engagement of ball with club and subsequently improve ball control, trajectory and speed. Further the golfing apparatus includes a movable member configured to slide along a path defined by the guide member and coupled with the putter handle. The guide member is affixed to the waist of a golfer. The guide member is curved to follow a natural rotation of arms and shoulders of the golfer and can be adjusted for proper angle that best fits a golfer's stance and has a second planar back stop surface to further align and control the movement of the putter club head, thereby assisting the golfer in putting.

5 Claims, 17 Drawing Sheets

GOLF PUTTING TRAINING AID

CROSS REFERENCES TO RELATED APPLICATIONS

This non-provisional application is a Continuation-in-Part of U.S. non-provisional application Ser. No. 16/266,062 entitled "Golf Putting Training Aid" and filed Feb. 2, 2019.

BACKGROUND

The invention relates generally to golf training aids, and more particularly, golf putting training aids to improve a user's swing. Putting is an important aspect of golf. During putting, the golfers generally bend towards a golf ball, and hit the golf ball with a golf club for displacing the golf ball towards an aimed hole on the golf course.

However, such striking of the golf ball often fails to displace the golf ball substantially closer to the aimed hole. Accordingly, golfers both experienced and beginners repeatedly practice putting strokes aiming to accurately put the golf ball in the aimed hole. However, since arms, wrists and body of golfers are unrestrained, every golf stroke may result in a different and inconsistent swing of the golf club.

Figure 1:
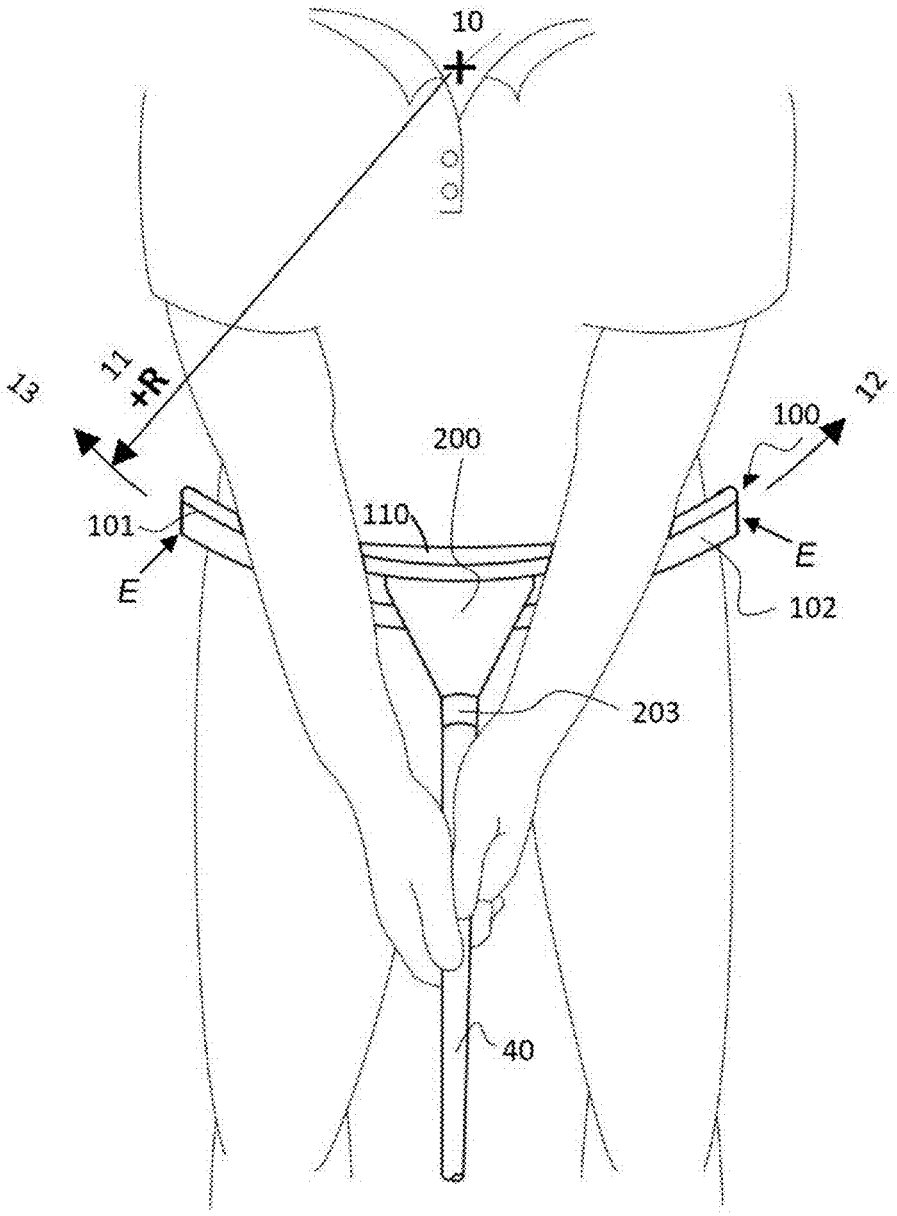
FIG. 1 is a front view of the golf putting training aid apparatus secured to the waist of a partial golfer standing in the putting position and having a putter received therein.

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label. The advances and features of the present disclosure will become better understood with reference to the following detailed description and claims taken in conjunction with the accompanying drawing, in which:

SUMMARY OF THE INVENTION

In one aspect, the present invention is a training apparatus to assist a golfer in performing a putt on a golf ball by allowing only certain necessary body motions and restraining and inhibiting certain other body motions. The training apparatus inhibits any wrist motions and guides the shoulders and arms together as a rigid unit through the full swing of the golf club, including the back swing and the forward swing and strike of the golf ball. The training apparatus may also provide a visual indication of hip position and assist the golfer from rotating the hips through the swing.

One embodiment of a golfing apparatus, for assisting a golfer in playing golf may include a guide member attached to a belt secured to the waist of the golfer. The guide member is aligned with respect to the ground plane and communicates the proper swing path to the hands of the golfer through a movable member adapted to receive a handle portion of a golf club The free travel of the movable member along the curve in the guide member may steer the swing of the golf club received in the moveable member, thereby assisting the golfer in playing golf.

The foregoing and other objects, features, and advantages of the invention will become more apparent from the following detailed description, which proceeds with reference to the accompanying figures wherein the scale depicted is approximate

DETAILED DESCRIPTION OF THE INVENTION

Reference Listing (10) Center of Radius
(11) Swing Radius
(12) Fore stroke trajectory
(13) Back stroke trajectory
(20) Vertical Plane normal to ground along intended putting trajectory and through eye point (21) Plane normal to the ground and extended from the vertical back surface 102 of apparatus
(30) Angle α of belt face with carrier guide angle
(40) Golf Club
(41) Golf Club Head
(50) Angle β of golf club shaft with plane of carrier block
(60) Intended path of the golf ball
(70) Angle of Action
(100) Guide Angle
(100*a*) Radial Leg
(100*b*) Vertical Leg
(101) Curved Radial Surface
(102) Back Surface
(103) Front Surface
(104) Lower Surface
(105) Belt Attachment Clips
(106) Guide Hinge
(110) Conformal Pad
(200) Carrier Block
(200*a*) Carrier Block in shifted position
(201) Carrier Block Slip Surface
(201*a*) Carrier Block Vertical Slip Surface
(202) Throat
(202*a*) Angular adjustment joint
(203) Club handle adaptor
(300) Belt
(301) Strap
(302) Belt Buckle
(400) End adjustable golfing guide apparatus
(500) Guide Angle
(500*a*) Sprung radial leg
(500*b*) Vertical Support Plate
(501) Curved Radial Surface
(502) Back Surface
(503) Support plate stiffener
(504) Spring steel slots
(515) Wing bolt
(516) Spring support cylinder
(520) Back guide hook
(521) Spring inner support pins
(522) Spring support head
(523) Splice plate
(524) Splice plate fasteners
(530) Height adjustable pole
(531) Upper pole
(532) Lower pole
(600) Asymmetric clamp carrier
(610) Arm (2 places)
(620) Offset brackets
(621) Bracket pivot
(639) Arm pivot
(640) Torsion Spring
(641) Spacer
(642) Wheels
(643) Axle
(650) Base plate
(700) Center adjustable golfing guide apparatus
(704) Spring steel notches
(715) Slotted spring end support
(716) Adjustable tab
(725) Inner support pin adjustment holes
(800) Symmetric clamp carrier
(820) Clamps

Definitions

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-9, a golfing apparatus is for assisting a golfer in putting. Specifically, the golfing apparatus may be attached to a belt and secured around the waist of a golfer. A putter or other golf club that may be substituted to make a putt or chip stroke may be attached to the golfing apparatus. The golfing apparatus is adapted to guide the swing of the putter, thereby assisting the golfer in taking putting or chip shots. Further the golfing apparatus also assists the golfer in maintaining the proper posture and swing form. In addition, the golfing apparatus restrains movements of the wrist while aligning the swing path of the golf club head 41 in a plane. It provides a visual cue to the golfer for any hip rotation that may misalign the swing trajectory. The golfing apparatus described herein encourages a muscle memory by emphasizing and isolating the proper movements of the golf putting swing so that the golfer has less degrees of freedom to control. By focusing on only an isolated degree of movement, the golfer can achieve a superior degree of control of golf club head speed and improve both alignment of the golf ball's trajectory and distance traveled. The particular design and arrangement of features in the golfing apparatus described herein enable the golfer to perform a proper putting stroke while preventing errant motions that affect ball control.

Referring to FIG. 1, this depicts one embodiment and shows respectively a golfer in the putting stance and holding a golf putter 40 attached to a carrier block 200 through a club handle adaptor 203. The carrier block is brought in contact with a guide angle 100 and sliding freely along a curved radial surface 101 arc segment with a center of radius 10 located in proximate position of golfer's upper chest and lower neck region around the sternum and on the golfer's vertical plane of bilateral symmetry. The carrier block 200 slides along the curved radial surface, 101 and a back surface 102 guiding the motion trajectories of a back stroke 13 and fore stroke 12. In other embodiments, the back surface 102 and the curved radial surface are blended with a fillet. The carrier block 200 may then be in direct communication with the fillet area. In some implementations, the length of the carrier block may be adjusted by interchanging handle adaptors of different lengths—or, the handle adaptor or that portion of the carrier block mating with the handle adaptor may be configured to telescope. Alternately, the end of the handle adaptor facing the carrier block may be threaded such that the distance between the handle adaptor and the carrier block can be adjusted.

The ideal swing radius 11 of the curved radial surface 101 would vary with the height of the golfer. Because of proportionate arm and torso lengths, a short golfer would swing along a smaller swing radius 11 and a taller golfer a larger swing radius 11. In some embodiments, the swing radius 11 for an adult golfer would be between 18 and 27 inches depending on their height, uprightness of stance, and relative lengths of arm and torso to their height. For other embodiments, a child's apparatus may have a swing radius 11 shorter than 18 inches depending on their bodies' relative proportions of torso, and length of arms. The disclosure herein refers to a swing radius or radial arc segment, and in other embodiments, other types of curve segments may be used and approximated such as an elliptical arc, and other portions of a parabolic, trigonomial, or other polynomial curve of various degrees can also be used to guide the motion of the hands and wrists through the golf swing.

FIGS. 1-9 and the description thereof are arranged for a right handed golfer. In one embodiment, the golfing apparatus can be fitted to either a right handed or left handed golfer. The swing radius 11 symmetrically guides back stroke 13 and fore stroke trajectories 12 and motions. In other embodiments, the guide angle 100 is proportioned for a combined motion path, of a backswing and a fore swing. In the particular illustrated implementation, the apparatus is assymetric and meant solely for right handed or left handed golfers. The arc segment of the carrier guide angle 100 should be sufficient to capture the whole range of putter motion from a full backswing to a full foreswing and allow for maximum putting distances. In some embodiments the arc segment is between 9 and 18 inches. In other embodiments the arc segment is between 10 and 13 inches.

Figure 2:
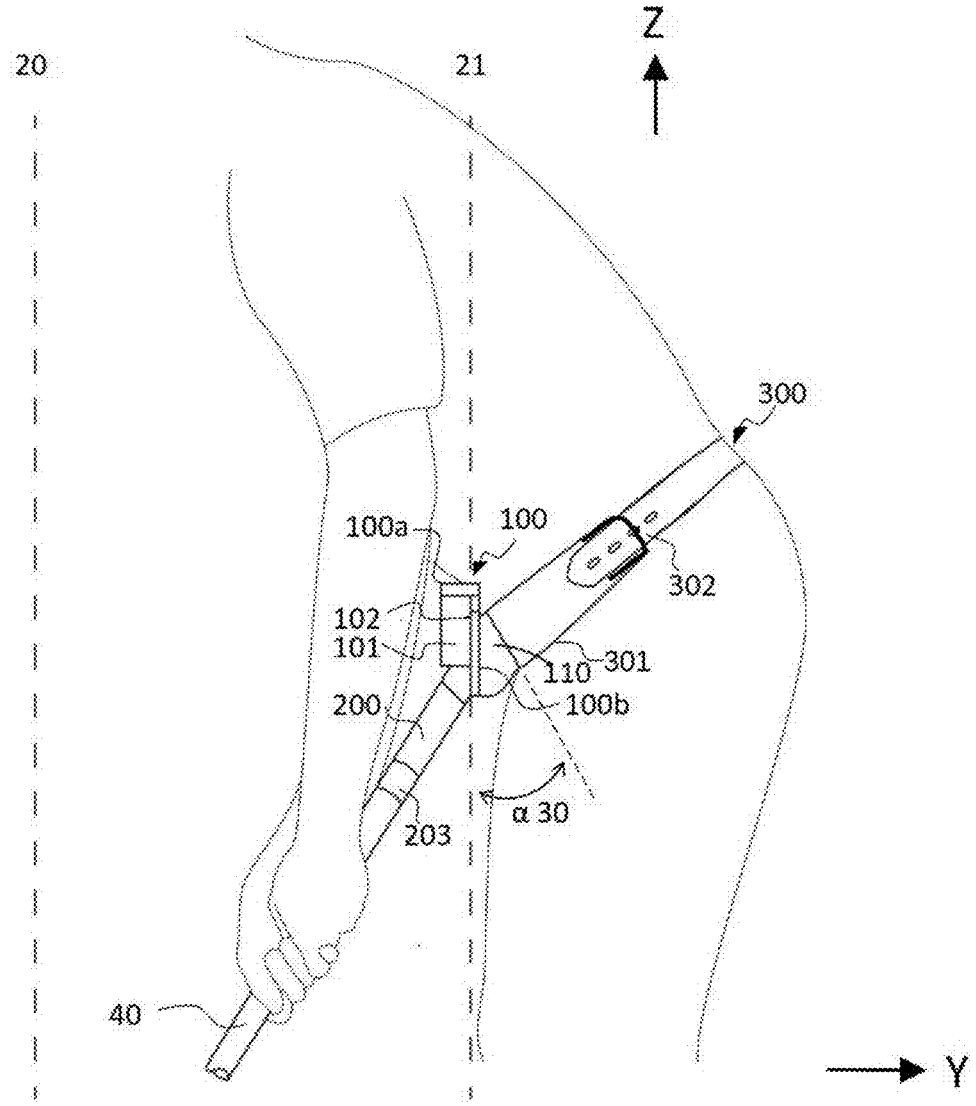
FIG. 2 is a side elevation view rotated 90° relative to that of (FIG. 1), showing the golf putting training aid apparatus secured to the waist of the partial golfer standing in the putting position and having a putter received therein.

As shown in FIG. 2 the golfer is in the proper putting stance. The golfer is holding a golf putter 40 attached to a carrier block 200 through a club handle adaptor 203. The carrier guide angle 100 is aligned with respect to the golfer's stance. The front portion of the waist of the golfer is at an angle $\alpha$ 30 with a plane normal to the ground 21 and extended from the vertical back surface 102 of apparatus. The angle $\alpha$ 30 may vary depending on the physique of the golfer. In some embodiments, the angle $\alpha$ 30 may be adjustable. The carrier guide angle 100 is designed to be in a position where the back surface 102 of the carrier guide angle 100 is aligned in vertical plane 21, approximately normal to the ground surface and parallel to a vertical plane normal to ground along intended putting trajectory 20. The back surface 102 is contained on the vertical leg 100*b* of the guide angle 100. The curved radial surface 101 is contained on the lower side of the radial leg 100*a* of the guide angle 100. The golfing apparatus may be affixed to a waist belt 300. In some embodiments, the waist belt buckle 302 may be positioned at the side of the golfer's waist to avoid interference with the attachment of the apparatus to the belt strap 301. In another embodiment, the apparatus can be attached and removed from a standard belt.

Figure 3:
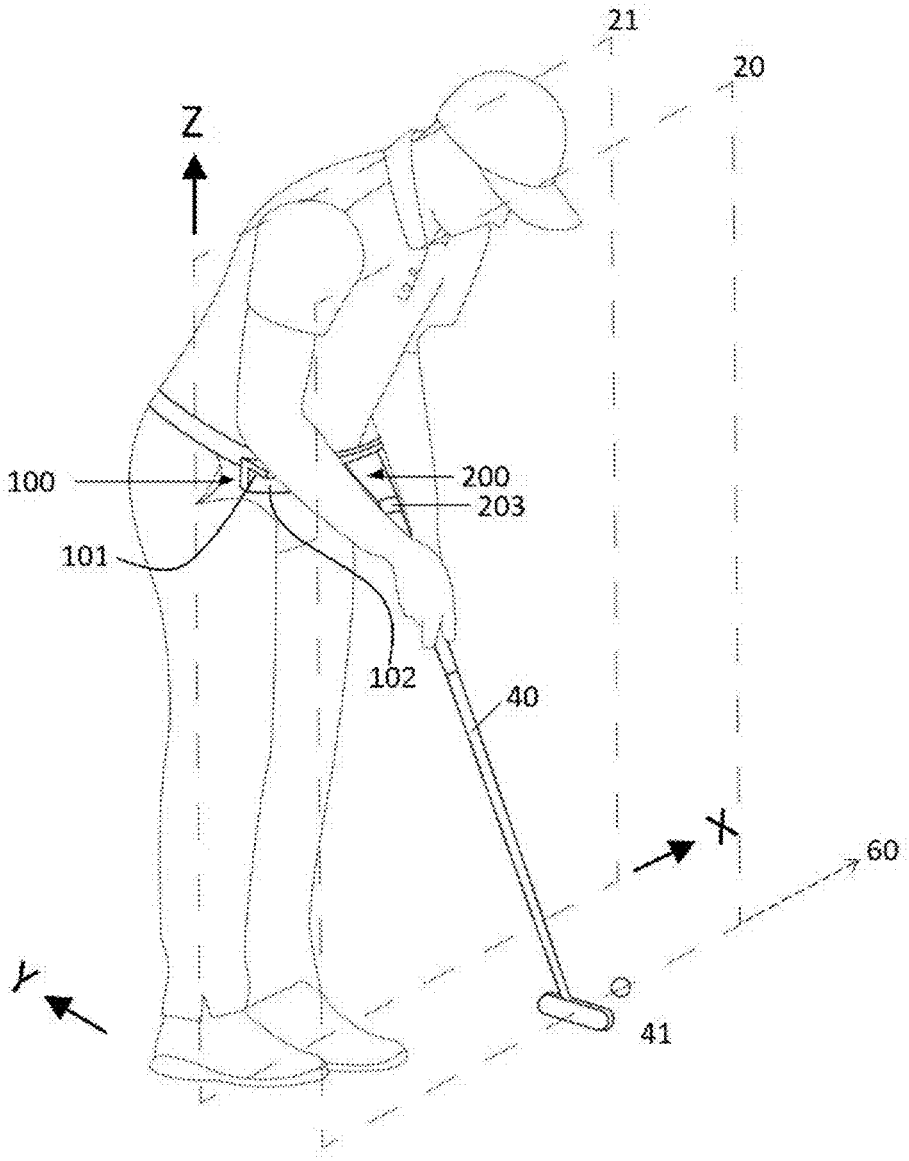
FIG. 3 is a perspective view of a golfer putting with the training aid apparatus secured to the waist and having a putter received therein.

As shown in FIG. 3, when the golfer is in the putting stance, the golfer is looking straight down over the top of the putter head in the plane 20. As the golfer takes a proper swing at the ball, the track of the head of the putter stays in plane 20 normal to the ground and the eyes remain fixed directly over the track of the golf club head. This defined motion ensures the striking surface of the putter head contacts the golf ball normal to the intended line of action of the golf ball 60. The motion of the putter head 41 is controlled by constraining the motion of the upper and back edges of the carrier block 200 along a parallel plane 21 passing through the back surface 102 of the guide angle 100 and along the radial surface 101.

As shown in FIG. 3, the head 41 of the golf putter 40 is kept in the vertical plane normal to ground along intended putting trajectory 60 by the constraint of the motion from the sliding contact of the carrier block 200 wedged between the curved radial surface 101 and the back surface 102 of the carrier guide angle 100. The apparatus guides the golfer to keep their waist from rotating by aligning the carrier guide angle 100 with the intended path of the golf ball 60 during the entire stroke. The intended path of the golf ball is in the X direction. The Y direction is pointed from behind the golfer and the Z direction upward and normal to the ground plane. The golfer's shoulders, arms, and wrist should be locked together as a rigid body. This rigid collection of body parts should rotate and wind up along an axis approximately along the spine of the back with the arms in a fixed position relative to the shoulders and with putter 40 held in a fixed position with the hands relative to the shoulders and arms The golfer's awareness of any motion of the hips is enhanced from a visual cue as the guide angle 100 shifts position through the swing. The golfer maintains a constant upward pressure on the golf club putter 40 during the swing providing continuous contact between the carrier block 200 wedged between the curved radial surface 101 and the back surface 102 of the carrier guide angle 100. The carrier 200 freely slides up against the curved radial surface 101 of the carrier guide angle 100 as the golfer reaches back 13 as shown in FIG. 1 and then strokes the putter forward 12 to contact the ball.

During a typical untrained, or unassisted golf putting stroke the track of the putter head can deviate from the defined motion and strike the golf ball at an angle to the intended line of action 60 or strike the surface while moving lateral or normal to the intended line of motion 60 during contact between the striking surface of the putter head 41 and the golf ball, an unintended golf ball response will occur. Then, the golf ball will take an unintended path and a spin can be imparted on the golf ball that causes the golf ball to curve off the line of action. Conversely, the golf putting training aid apparatus is designed to align the golfer's stance and maintain the proper alignment through the stroke, thereby increasing muscle memory of the motion and aiding the golfer in replicating the motion without the training aid.

In order to properly position the carrier guide angle 100 to the golfer's physique, the mounting angle $\alpha$ of the carrier guide angle 100 with the face of the belt 30 should be adjusted such that the curved radial surface 101 is in a vertical plane 20 normal to the ground surface and equal distance from each of the golfer's left and right toes when the golfer is in the putting stance. In one embodiment, this angle is adjustable using a guide hinge 105. In another embodiment, the angle is determined for the golfer's physique, body structure, and stance and the carrier guide angle 100 manufactured with the customized angle incorporated into the part.

Figure 4:
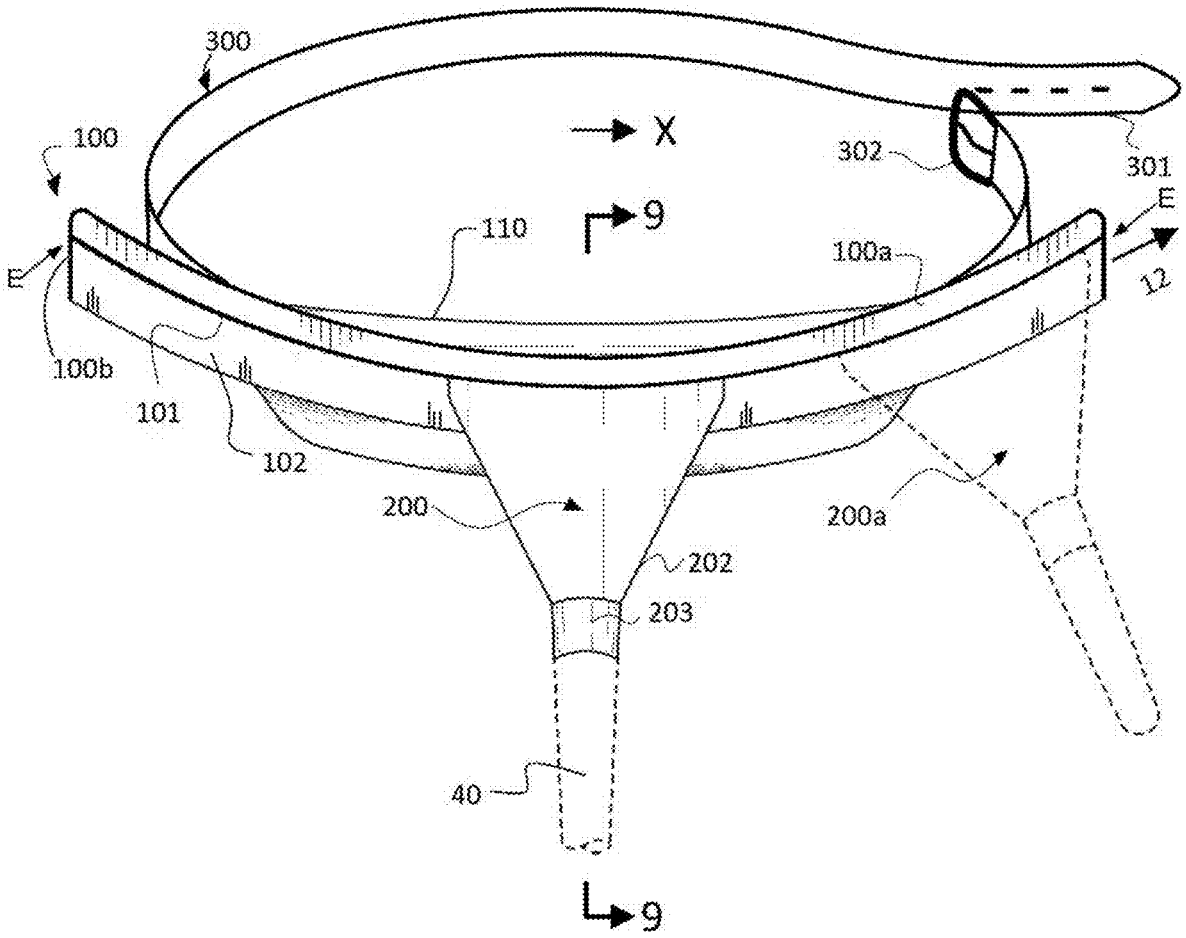
FIG. 4 is an enlarged front view taken in the direction of the Y axis as shown in FIG. 2 of golf putting training aid apparatus as in (FIG. 1) with the partial golfer removed.

As shown in FIG. 4 the carrier block 200 is shown in the neutral position and a phantomed position of the carrier 200*a* is in a rotated position relative to the carrier guide angle 100 during the end of the stroke from a right handed golfer along the fore stroke trajectory 12. The conformal pad 110 adapts the golfer's physique to the approximate vertical plane 21 shown in the plane of the view and passing through the back surface 102 of the vertical flange 100*b* of the angle guide 100. The belt 300 with strap 301 is unsecured from buckle 302. The golf club 40, depicted as phantomed in FIG. 4 is, attached to the throat 202 of the carrier 200 with a club handle adaptor 203. The curved radial surface 101 shown on the lower side of the radial flange 100*a* of the angle guide 100.

Figure 5:
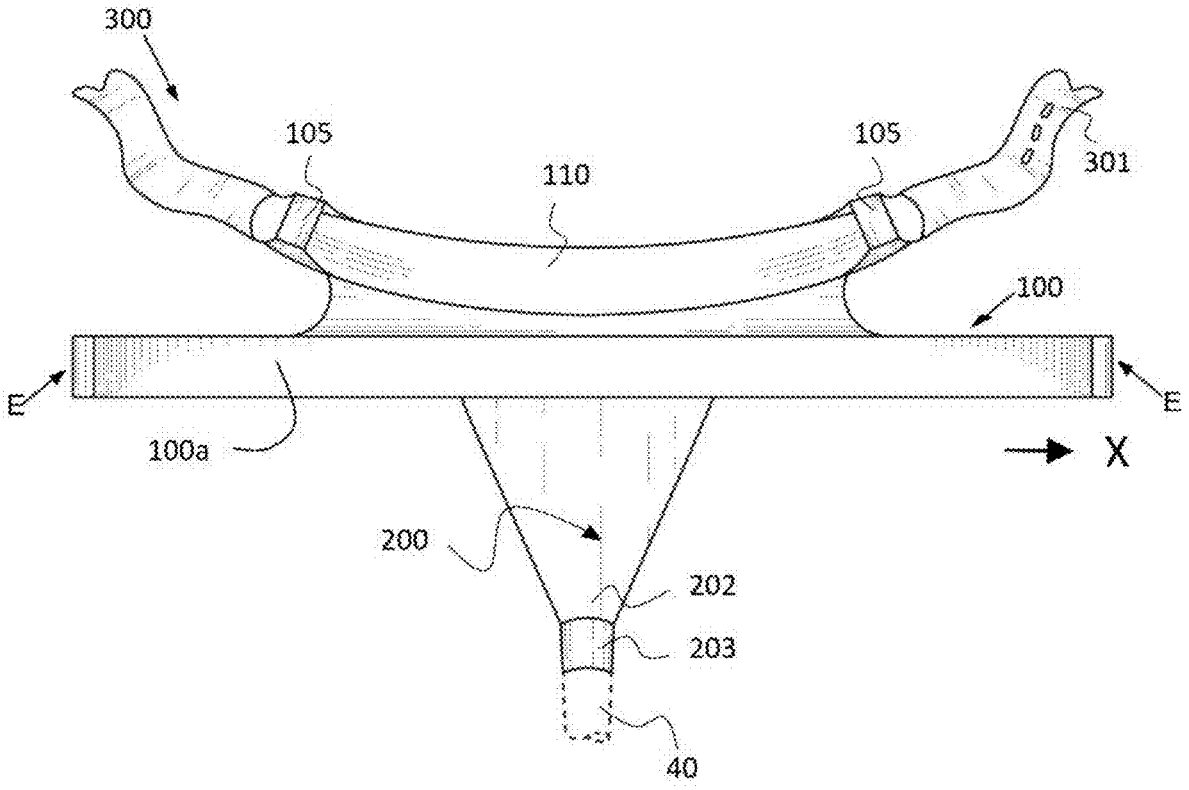
FIG. 5 is a top view of golf putting training aid apparatus.

As shown in FIG. 5, the carrier guide angle 100 is affixed to the front center portion of a belt 300 through belt attachment clips 105. The belt strap 301 passes through the belt attachment clips 105 mounted on the carrier guide angle 100 and secures the carrier guide angle 100 against the body of the golfer. The belt can be tightened through a buckle, ratchet, clamp, or other tightening means 302. In some embodiments the guide angle 100 assembly clips on to a standard belt with the buckle 302 in the front position behind the carrier block in the neutral position.

Figure 6:
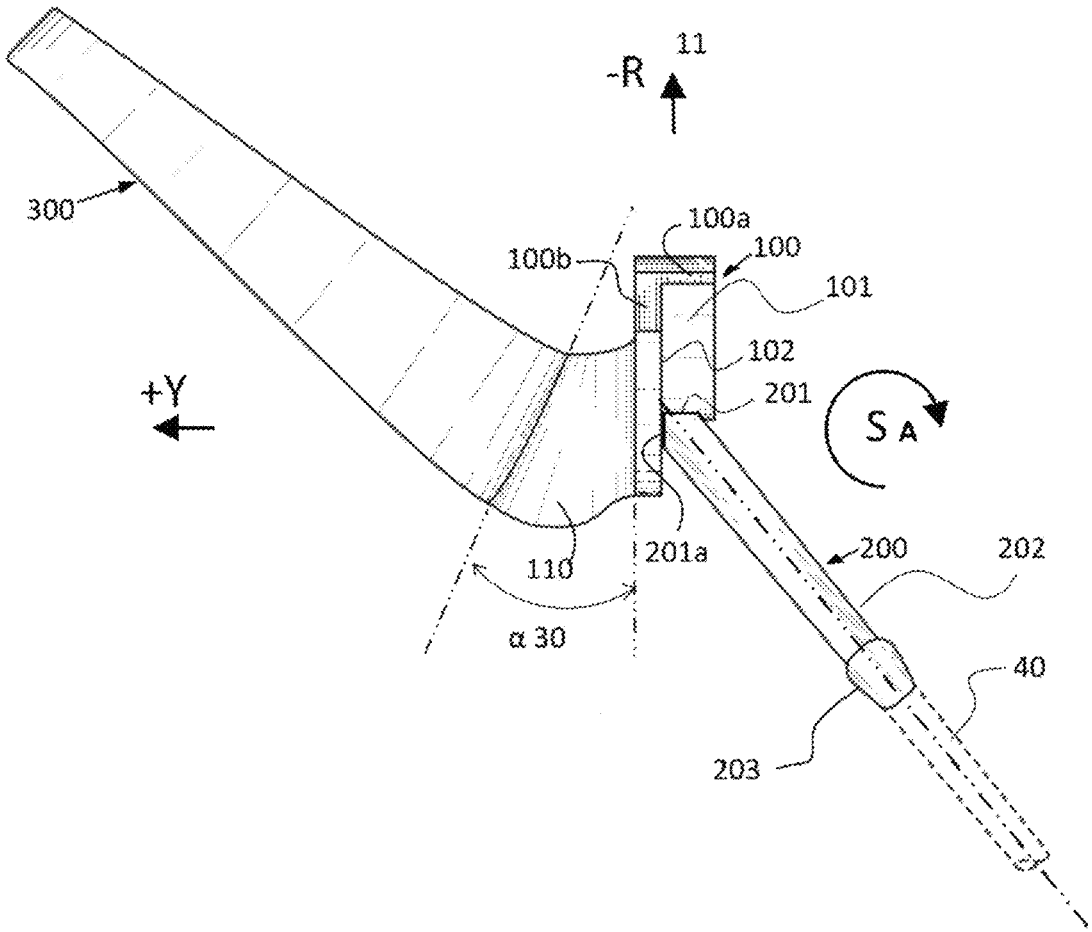
FIG. 6 is an enlarged side view of golf putting training aid apparatus.
Figure 9:
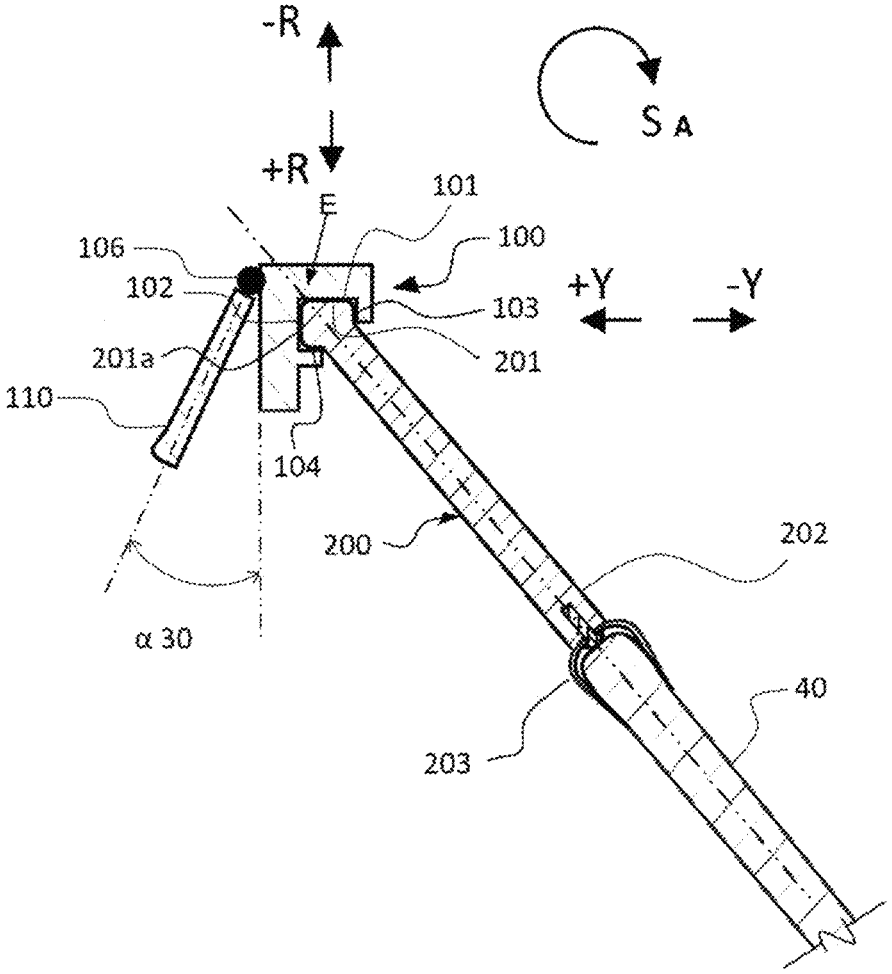
FIG. 9 is a cross sectional view of FIG. 4 taken along lines 9-9 of (FIG. 4), however showing another embodiment according to the present invention, where instead of a fixed conformal pad 110, the conformational pad is adjustable and instead of a separable carrier 200, the separable carrier 200 is retained and not directly separable by simple translation in the −Z and −Y directions from the guide angle 100.

As shown in FIG. 6, a carrier block 200 has slip surfaces 201 and 201*a* that remain in contact with the curved surface 101 of the carrier guide angle 100 and the back surface 102 during the stroke of the putter. The slip surfaces between the curved radial surface 101 and the carrier block slip surface 201, and the back surface 102 and the carrier block vertical slip surface 201*a* can be enhanced by using low friction materials such as a polished surface or TEFLON™ or another low friction material on one of the surfaces and TEFLON™ or felt on the other. In other embodiments, the wheels and bearings can be affixed to carrier block 200 to enable it to roll along the carrier guide angle 100. Upward pressure imparted by the golfer keeps the carrier 200 in contact with the guide 100. The guide 100 traps the carrier 200 and controls its position in the −R swing radial direction 11 with center of radius 10 as shown in FIG. 1 and +Y axis directions. Rotation of the carrier along the stroke arc direction $S_A$ is also restricted to some degree by the squared up and aligned connection between the mating surfaces 201 against 101 and 201*a* against 102. The golf club 40 is affixed to the carrier 200 throat 202 with a club handle adaptor 203, although any number of means can be used to affix the club handle to the carrier block with varying degrees of rigidity, FIG. 6 also shows a deformable conformal cup handle adaptor 203 that can accommodate various golf club handle shapes and cross section profiles. A cross sectional cut through the club handle adaptor is shown in FIG. 9.

Figure 7:
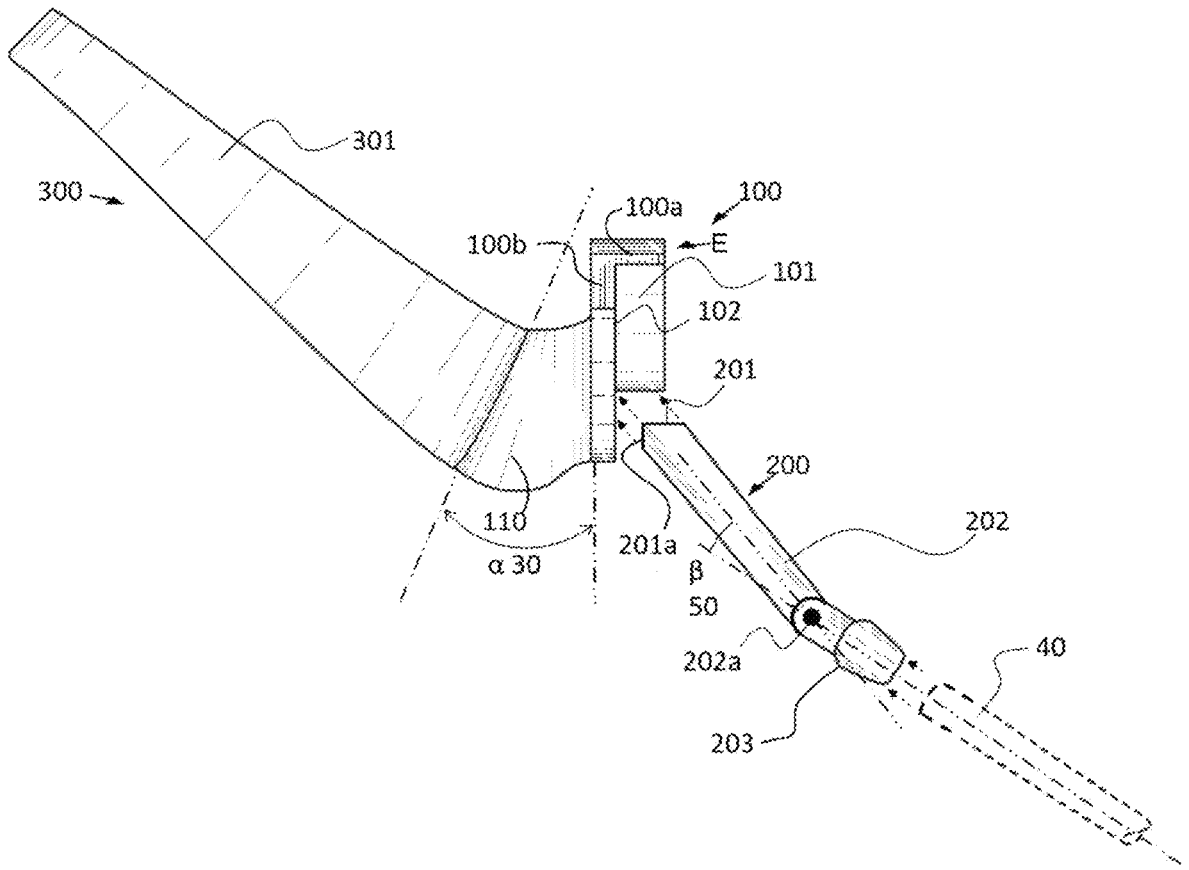
FIG. 7 is a side view of golf putting training aid apparatus with the carrier block 200 shown separted from the guide angle 100 and the phantomed golf club 40 separated from the club handle adaptor 203.

As shown in FIG. 7 the carrier block 200 is in a position separated from the carrier guide angle 100. In one alternate embodiment, there is an adjustment means to change the angle β 50 of golf club shaft 40 with the plane of carrier block 200. The angular adjustment joint 202*a* is also shown in FIG. 8 and can be used to maintain full contact between the carrier slip surface 201 and the curved radial surface 101 while also maintaining alignment with the back surface 102 and the vertical contact surface 201*a*.

The golfer applies an upward force through the golf putter handle that keeps the carrier block 200 pressing against the carrier guide angle 100. To prevent the golfer's wrists from rolling during the stroke, an additional back surface 102 of the carrier guide angle 100 prevents the rotation of the carrier block 200 along the axis of the golf putters handle.

The golfer attaches a putter to the club handle adaptor 203. The club handle adaptor 203 is flexible and conforms to various shapes of golf putter handles and grips the handle such that the handle is affixed to the club handle adaptor 203 and, in some embodiments, the golf putter is prevented from rotating along its handle axis. The club handle adaptor 203 is fixed to the carrier block 200 through a throat 202 transition. The golf putter held in the proper position will take on an angle of the golf putter shaft 50 with the plane of the carrier block 200. An adjustment in the angle 50 can be made at the angular adjustment joint 202*a* as shown in FIGS. 7 and 8.

Figure 8:
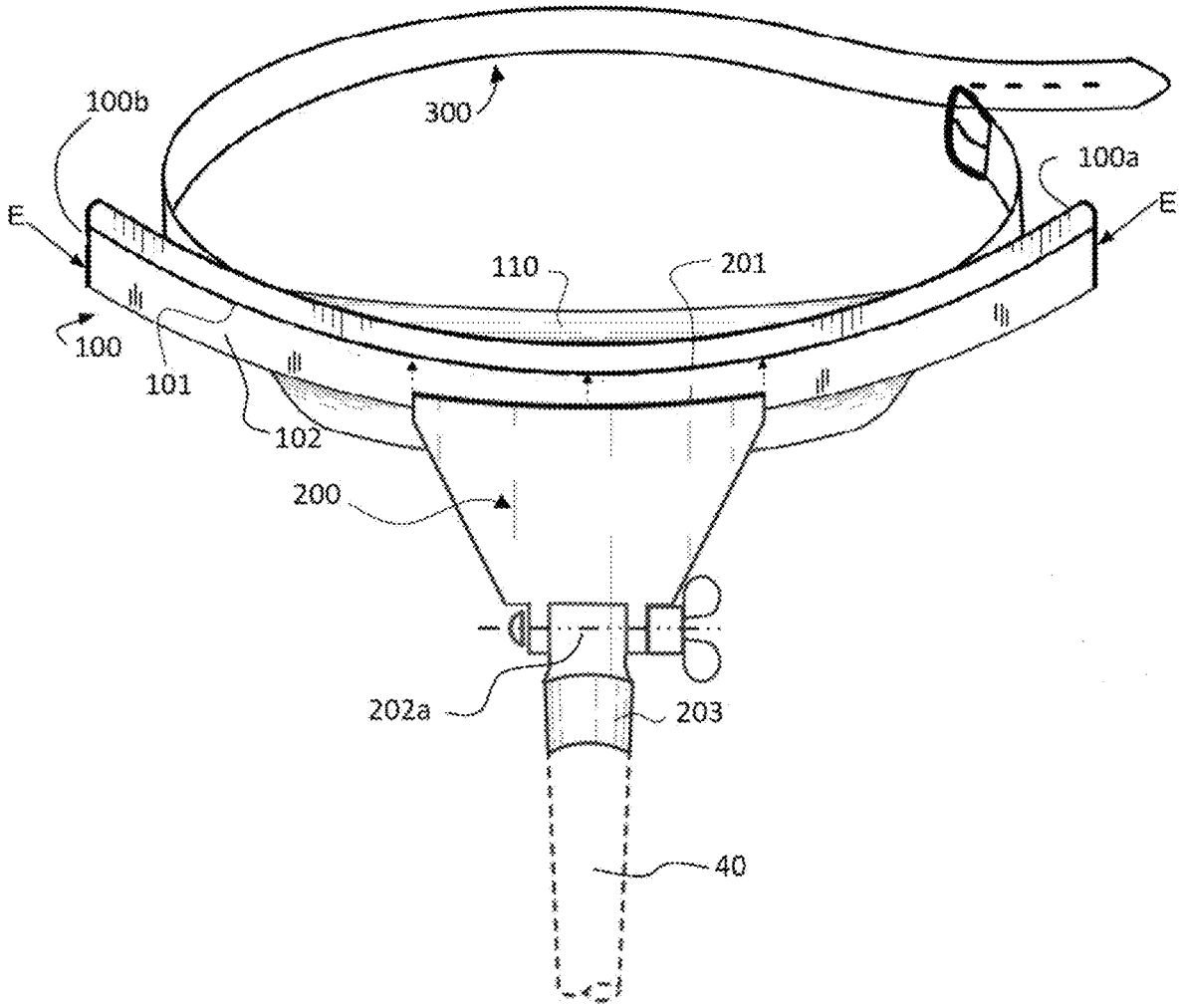
FIG. 8 is a frontal view of golf putting training aid apparatus with the carrier block 200 shown separted from the guide angle 100.

FIG. 8 also shows the carrier 200 assembly separated from the guide 100 assembly. The carrier slip surface 201 is separable from the curved radial surface 101. The curved radial surface 201 is depicted similarly in FIG. 4 on the lower surface of an arc shaped flange as part of the guide 100 and shown in FIG. 6 as the lower surface of a flange extending in a direction normal to the vertical plane 21 as shown in FIG. 3 out from and over the vertical flange on the guide 100

FIG. 9 depicts still another alternate embodiment where additional constraints are added between the carrier 200 and the carrier guide 100. In addition to the contact mating surfaces 201 and 201*a* on the carrier 200 against 101 and 102 on the guide 100 that restrain motion in the +Y and −R directions, there are other features that constrain motion of the carrier 200 in the opposite −Y and +R directions, the front surface 103 and lower surface 104 on the carrier guide 100 respectfully. In this alternate embodiment, the carrier 200 is not separable during a normal golf putting swing, but can be still be separated from the guide 100 by extending the carrier along the backstroke trajectory 13 or along the forestroke trajectory 12 as shown in FIG. 1 beyond their normal stroking range and freeing the carrier 200 from the guide channel formed by the surfaces 101, 102, 103, and 104. In addition to the extra restraint for the radial and fore and aft traslational directions, the carrier 200 is also restrained from rotating about the stroke arc $S_A$, 12 & 13 swept by the radius R 11 as shown in FIG. 1.

In other embodiments, the carrier can be roller mounted on a track and made to be separable from the track or not separable. In some embodiments the track is contained inside a housing. The track can be a curved flat section oriented similarly to the radial flange 100*a*. In still another embodiment, the carrier can ride on a rod affixed on either distal end to and contained inside a housing. The housing contains a slot allowing an attachment rod to extend outward and connect to the golf club handle 40 and mounted on the back side to a conformal pad 110 and waist belt 300.

While the embodiments described herein are susceptible to various modifications and alternative forms and specific embodiments have been shown by way of example in the drawings, the exemplary embodiments described herein are not intended to be limited to the forms disclosed. Rather, the instant disclosure covers all modifications, equivalents, and alternatives falling within the scope of the appended claims.

Figure 10:
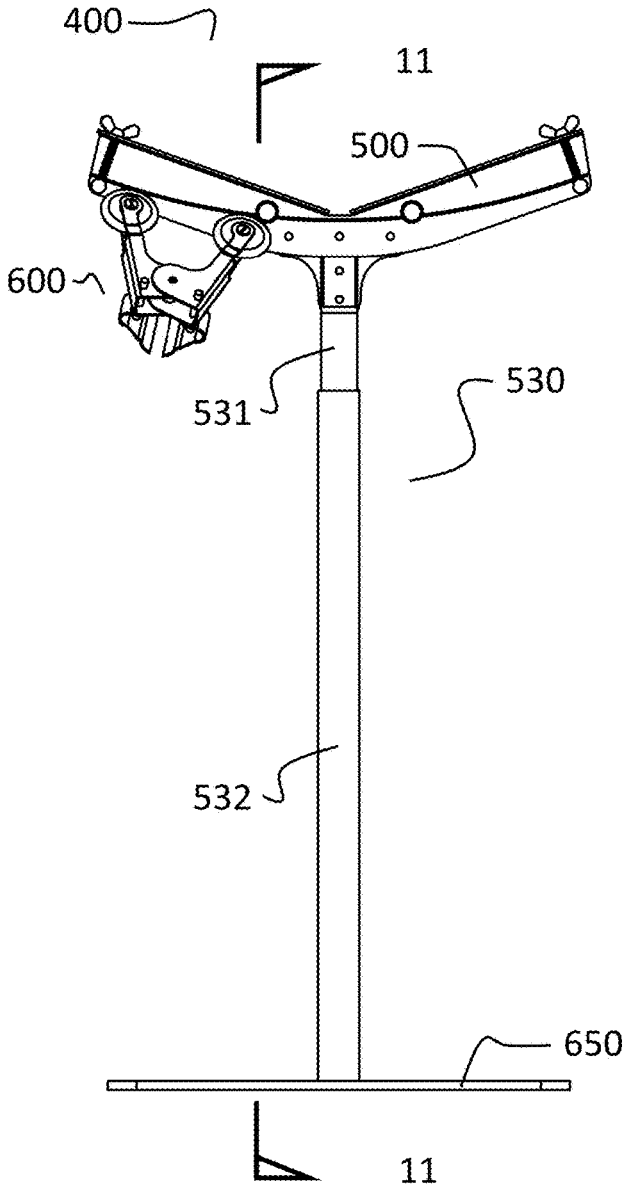
FIG. 10 is a front view of the end adjustable golfing guide apparatus and a stand assembly.

In still another embodiment as shown in FIG. 10, an adjustable golfing guide apparatus 400 is mounted on a height adjustable pole 530. A clamp carrier 600 is attached to the golf club 40 at the top of the grip and above where the hands are normally holding the golf club 40. The clamp carrier 600 is held up against the guide angle 500 such that the wheels 642 are in contact with the intersection of the vertical support plate 500*b* and the radial leg 500*a*. The clamp carrier 600 in FIG. 10 is shown in the position of the back of the swing for a right handed golfer. The height of the support pole 530 can be adjusted a number of ways including a telescoping upper pole 531 inserted into a slightly larger telescoping lower pole 532. The fit between the upper pole 531 and lower pole 532 can be tight enough to require force to move them relative to one another or a detent can be used to incrementally lock in and hold their relative positions. The height is adjusted such that the center of the guide angle 500 is in front of the normal position of a belt buckle.

By supporting an adjustable golfing guide apparatus 400 with a vertical pole 530 the need to adjust the angle 30 relative to the waist is eliminated. The pole support 530 insures the back support plate 500*b* remains aligned in the proper vertical position. Furthermore the pole should be stiff enough torsionally to prevent any noticeable rotation of the guide angle 500 as the golfer swings, eliminating any coupling with rotations of the golfer's hip. The golfer can clamp their golf club 40 to the carrier 600 and belly up to the adjustable golfing guide apparatus 400 while positioning their feet on both sides of the base plate to secure the whole apparatus to the ground. This embodiment eliminates the time needed to fit and adjust a belt and then adjust the angle 30 to keep the golfing guide apparatus 400 aligned in the proper plane of action 21. The golfer can switch from using the golfing guide apparatus 400 to help with swing technique to stepped aside and trying the technique out on their own and then returning back to using the golfing guide apparatus 400 to further perfect their swing technique.

Figure 11:
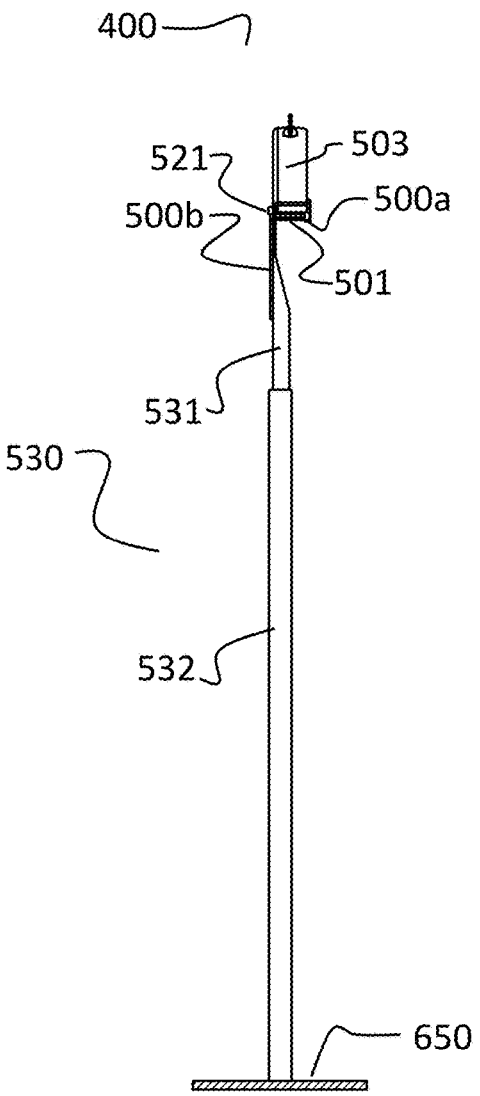
FIG. 11 is a cross sectional view of FIG. 10 taken along lines 11-11 and showing a side view of the stand assembly and a cross section of the guide angle.

FIG. 11 depicts a view from the side of the telescoping stand 530 and a cross section of the guide angle 500. The support plate stiffener 503 is shown extending from the vertical support plate 500*b* to provide bending stiffness and rigidity and to cover the adjustable spring steel leaf or radial leg 500*a* that has been elastically bent to form a near curved radial surface 501. The upper pole 531 is made from a hollow thin walled tube reinforced plastic extrusion and is cut at an angle to prevent it from interfering with the motion of the clamp carrier 600 as it travels from side to side. The upper pole 531 slides into the lower pole 532 made from a matching hollow thin walled tube reinforced plastic extrusion that provides a close tolerance fit between the inner surfaces of the lower pole 532 and the outer surfaces of the upper pole 531. The lower pole 532 is rigidly attached to a base plate 650 that supports the 400 adjustable golfing guide apparatus on the pole 530. In some embodiments the lower pole 532 can be easily detached from the base plate 650 to allow the apparatus to be easily stowed or shipped. In other embodiments the lower pole 532 is further supported by a strut (not shown) that spans between the upper portion of the front of the lower pole 532 and an extended portion of the base plate 650 and is in compression as the golfer pushes into the golfing guide apparatus 400 with their waist while their feet anchor down the base plate 650 against the ground.

Figure 12:
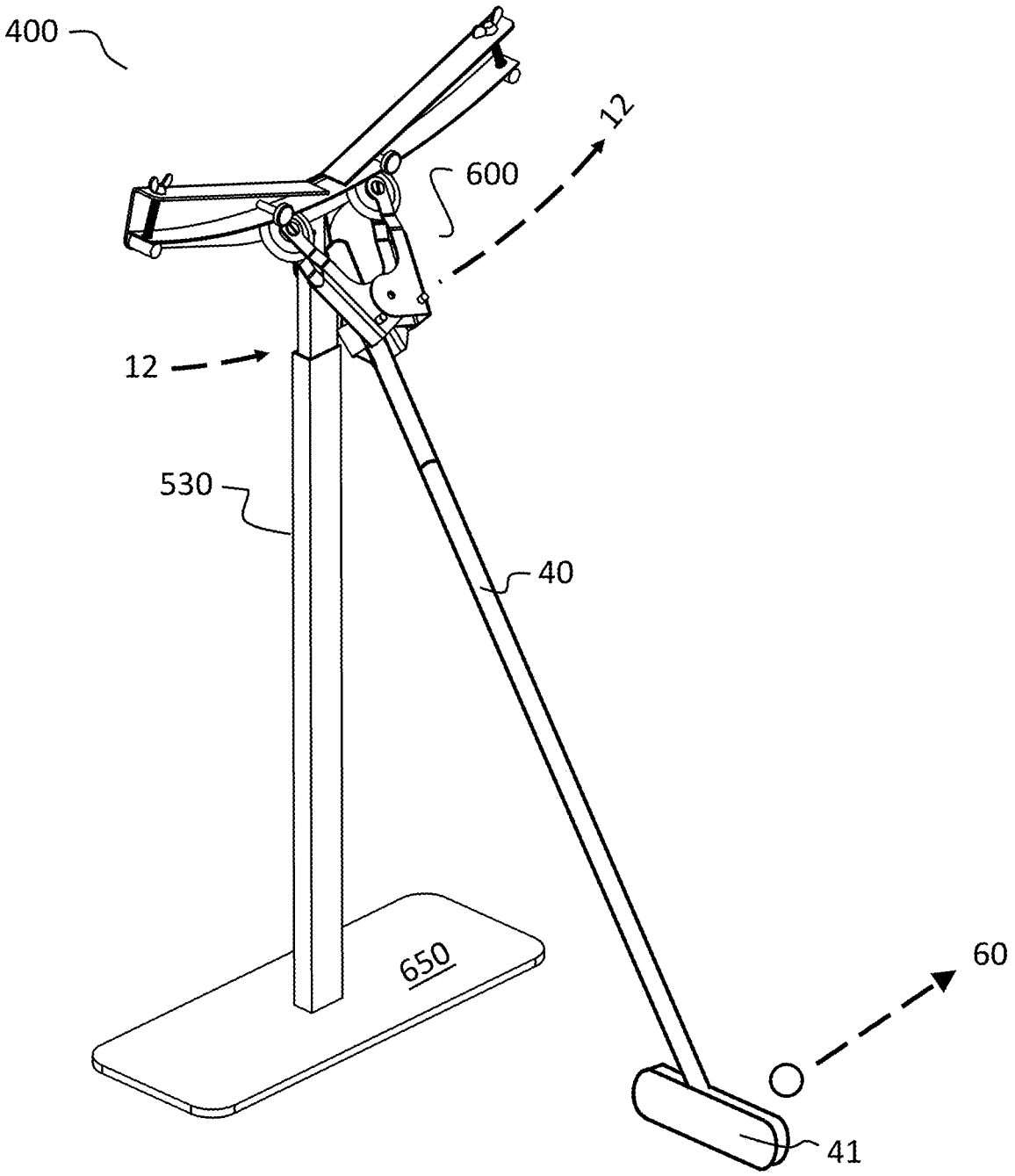
FIG. 12 is a perspective view of a golf putter received in the training aid apparatus.
Figure 14:
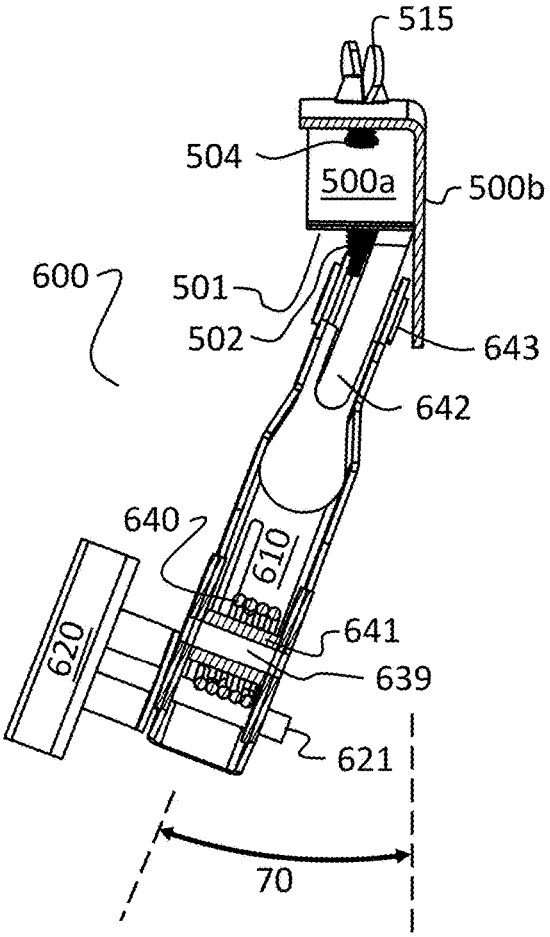
FIGS. 14 and 14*a* are a cross sections of the guide angle and both a cross section view and side view of the assymetric clamp carrier assembly.
Figure 15:
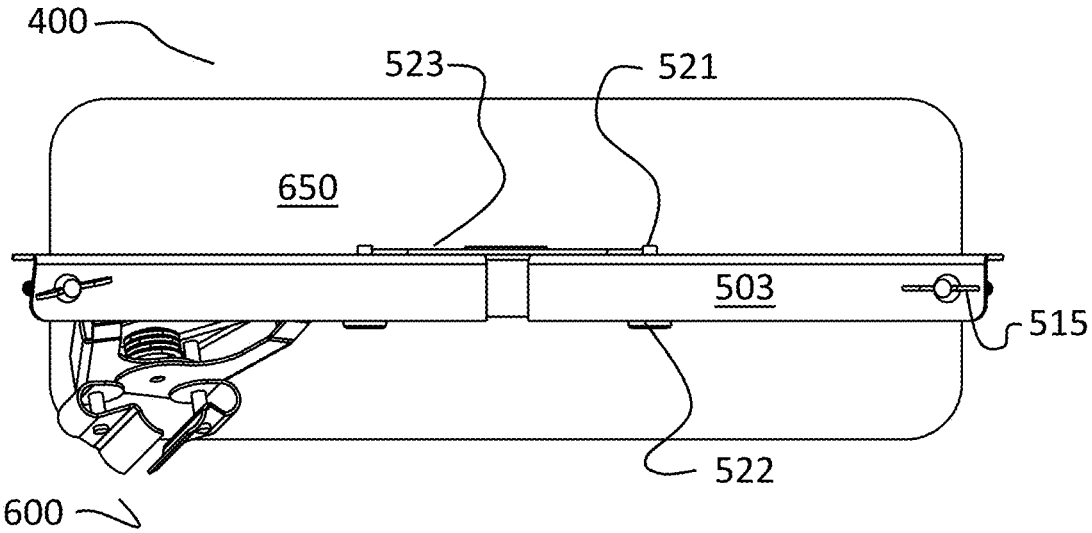
FIG. 15 is a top view of the end adjustable golfing guide apparatus and a stand assembly.

FIG. 12 depicts an adjustable golfing guide apparatus 400 from a view similar to FIG. 3 that shows a person holding a golf club 40 putter attached to a carrier 200 with a guide angle 100 strapped to a belt 300. The stand consisting of a height adjustable pole 530 and base plate 650 eliminates the need for a belt 300. FIG. 12 shows the assymetric clamp carrier 600 in the center or neutral position The two legs of the golfer would straddle both sides of the pole 530 with the golfer's feet resting on the base plate 650. The hands follow the path prescribed by the assymetric clamp carrier 600 as it moves along a path of the fore stroke trajectory 12 and the ball is impacted and takes its intended path 60. The golf club 40 is positioned under the asymmetric clamp carrier 600 but can also be positioned on the top of the clamp carrier 600 by inverting the clamp carrier 600 over to position the offset brackets 620 on to face up as shown in FIGS. 13 through 15.

Figure 13:
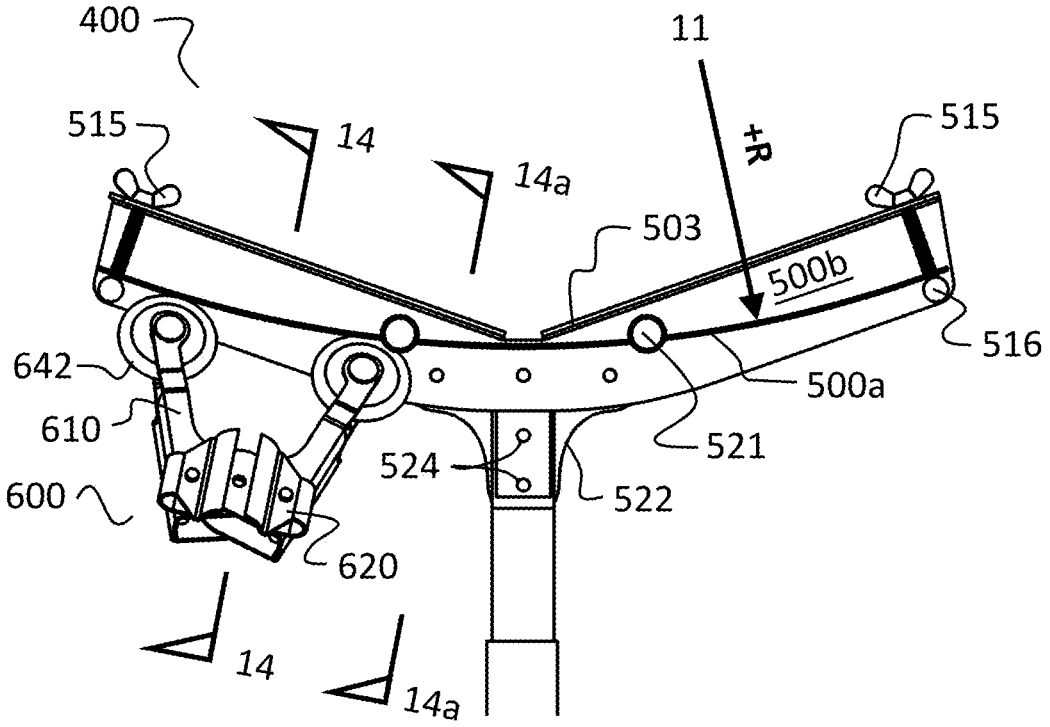
FIGS. 13 and 13*a* are enlarged frontal views of the end adjustable golfing guide apparatus showing the two extreme positions of curvature.
Figure 13A:
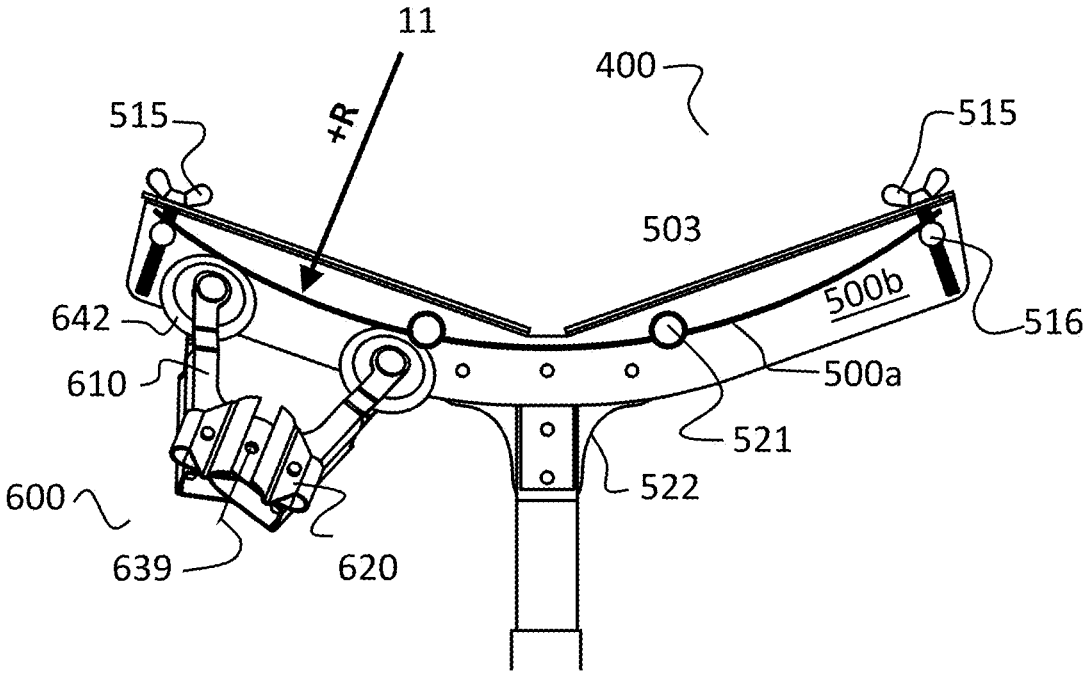

FIG. 13 shows a close up of the adjustable golfing guide apparatus 400. The sprung radial leg 500*a* is shown in its highest radius position matching the rigid body motion of a taller golfer's shoulders and arms about an axis approximately down the spine. The adjustable golfing guide apparatus 400 is designed to only allow this rigid body motion and taking away any other errant motions that cause error in a putting or chipping stroke. FIG. 13*a* shows the sprung radial leg 500*a* is shown in its lowest radius position matching the rigid body motion of a shorter golfer's movement. The adjustable golfing guide apparatus 400 can be adjusted into any position between the two extremes shown in FIG. 13 and FIG. 13*a* by turning the wing nuts 515 located on the top of the vertical support plate 500*b* support plate stiffener 503. Both wing nuts are intended to be adjusted to the same relative position by turning until the sprung radial leg is pointing directly to the value matching the users height. The range of motions for one embodiment is from about 13 inch radius 11 to a 24 inch radius 11 equating proximately to a golfer height of about 4 ft.-10" inches to about 6 ft.-5 inches, a 19 inch range in heights. This embodiment also has the unique capability of an assymetric swing guidance where the swing trajectory is different before and after contact is made with the golf ball and is done by setting one of the wing bolts 515 to a different setting than the other.

The sprung radial leg 500*a* is made from spring steel that remains in its elastic range during the full motion from open to more closed radius positions. The spring thickness must be thin enough to elastically bend while stiff enough to retain its shape when pressure from the wheel 642 is applied. In some embodiments in order to accomplish both a series of thin springs in the 0.024 to 0.036 inch thick can be stacked and allowed to slide relative to one another to sufficiently bend yet still provide enough resistance to local deflection. The spring is cut to shape flat and preloaded against the lower side of the two inner spring support pins 521 shanks which have a larger diameter head 522 which engages the sprung radial leg 500*a* and keeps it pressed in contact with the back surface 502 of the vertical support plate 500*b*. The ends of the spring steel 500*a* is supported by spring support cylinders 516 which are positioned under the spring steel 500*a* ends. The cylinders are threaded perpendicular to their longitudinal axes and positioned and supported by wing bolts 515 that are mounted through slots 504 in the spring steel ends and the support plate stiffeners 503. The slots 504 allow the shortening of the segment length of the spring steel 500*a* as its radius 11 is reduced.

FIGS. 13 and 13*a* also show the splice plate 523 connecting the adjustable golfing guide apparatus 400 to the pole 530. To release the adjustable golfing guide apparatus 400 from the pole 530 the splice plate fasteners 524 can be removed. In some embodiments these splice plate fasteners 524 can be quick releasable by using for example push button ball detent type fastener that allows the golfer to reach down and easily and quickly separate the parts. The loose parts can then be retained with short wire lanyards for easy accessibility and reattachment. This feature can be useful when the adjustable golfing guide apparatus 400 is being used interchangeably with a belt 300 mount.

FIGS. 13 and 13*a* also show the clamp carrier 600 positioned to the backswing of a right handed golfer and with the brackets 620 offset to the outside of the carrier arms 610. The wheels 642 are attached to both arms 610 with low profile threaded post fasteners or axles 643. The offset brackets 620 are attached to the arms 610 with the bracket pivots 621 that allow the brackets to best position to grab and hold the handle of the golf club. The carrier 600 is designed to grasp regular golf putter handle cross sections, or smaller handle clubs or fat shaft or extra wide golf putters that enable both thumbs to be placed side by side on the top of the putter handle and keeping the position of both hands the same and allowing the shoulders to remain parallel to the ground in the neutral position before starting the backswing.

FIG. 14 depicts a cross section through the center of the clamp carrier 600 and showing the internal components of the clamp carrier 600 such as the torsion spring 640 and the spacer 641 that centers the spring coils with the arm pivot 639. The clamp carrier 600 is held up against the guide angle 500 such that the wheels 642 are in contact with the intersection of the vertical support plate 500*b* and the radial leg 500*a*. The wheel 642 is built with a solid O-Ring tread stretched over a wheel hub. The angle of action 70 of the carrier with the vertical plane is shown in FIG. 14 at about 20 degrees. In some embodiments the available range of motion is about 45 degrees plus or minus 25 degrees or about 50 degrees of angular motion as the wheel 642 rotates with respect to the guide 500.

The golf club 40 can be positioned along the handle from the very tip to approximately 6 inches down the club 40 shaft until it barely clears the guide angle 500. The carrier 600 can be installed by sliding the clamp carrier 600 after relieving the pressure from the offset brackets 620 by squeezing the clamp arms 610 together and overcoming the torsional spring 640 force. FIG. 14 also shows the sprung radial leg 500*a* with a slot 504 that allows the segment arc distance to shorten with a tighter radius 11.

Figure 14A:
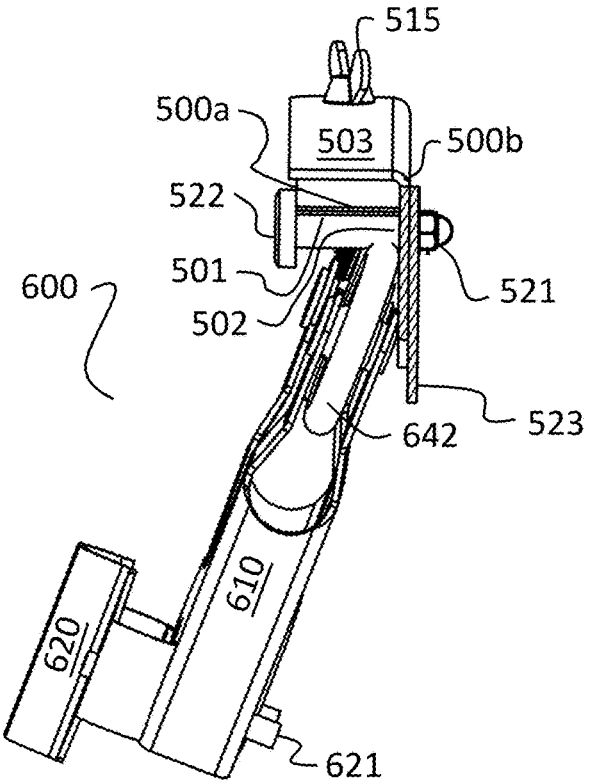

FIG. 14*a* depicts a view of the side of the clamp carrier 600 and clearly showing the intersection of the 2 surfaces the wheel 642 rides on. One is the adjustable curved radial surface 501 and the other, the back surface 502 of the vertical support plate 500*b*. The spring inner support pins 521 can also be seen as well as the retention of the spring by the spring support head 522. The spring inner support pins 521 pass through the vertical support plate 500*b* and the splice plate 523 and can be secured with a back nut (not shown).

FIG. 15 depicts a view looking down at the adjustable golfing guide apparatus 400 and the base plate 650 assembly. The support plate stiffener 503 covers over the steel spring 500*a*. A decorative cover cam also be used to hide the spring adjustment hardware. The wing bolts 515 are easily accessible at the top of the support plate stiffener 503. The base plate 650 is wide enough to rest both feet on (not shown).

Figure 16:
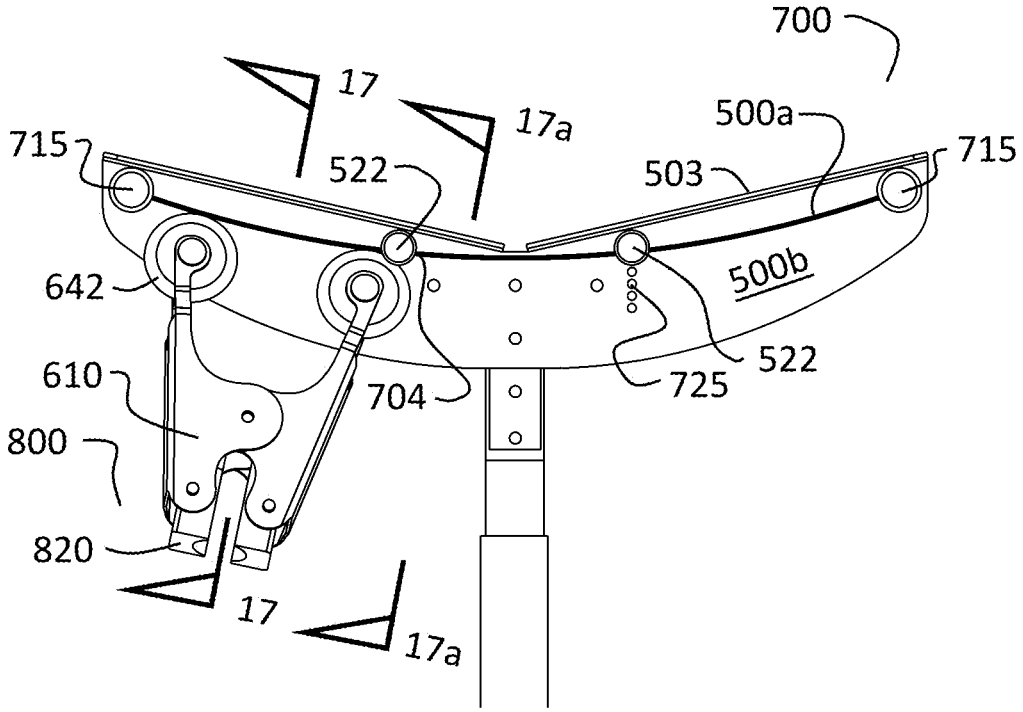
FIGS. 16 and 16*a* are enlarged frontal views of the center adjustable golfing guide apparatus showing the two extreme positions of curvature.
Figure 16A:
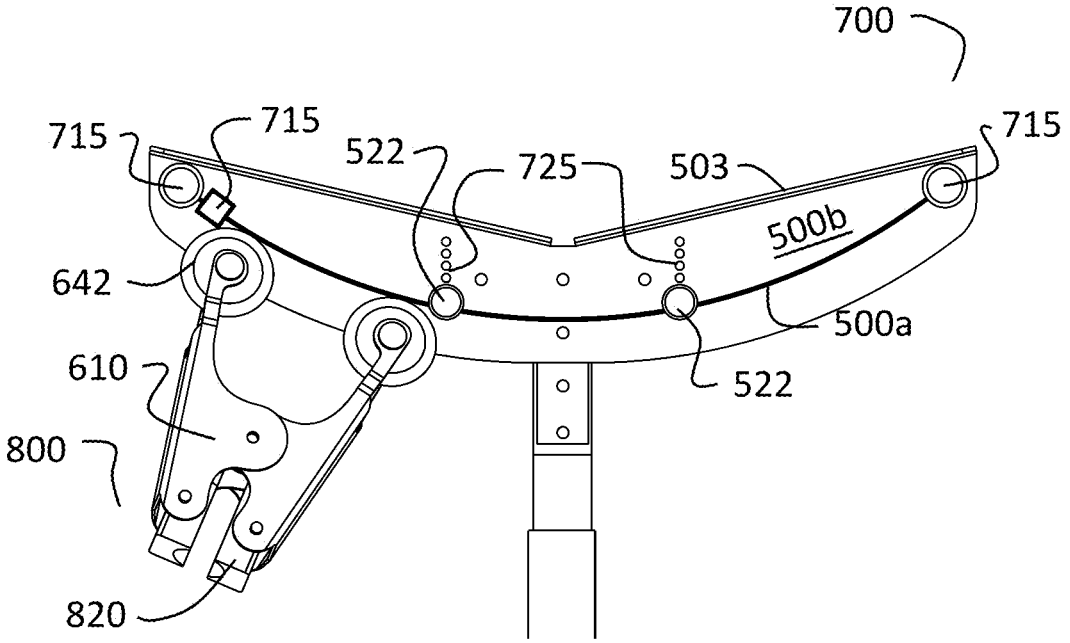

FIG. 16 shows a close up of the center adjustable golfing guide apparatus 700. The sprung radial leg 500*a* is shown in its highest radius position matching the rigid body motion of a taller golfer's shoulders and arms about an axis approximately down the spine. FIG. 16*a* shows the sprung radial leg 500*a* is shown in its lowest radius position matching the rigid body motion of a shorter golfer's movement. The adjustable golfing guide apparatus 400 can be adjusted into any position between the two extremes shown in FIG. 16 and FIG. 16*a* by resetting the spring inner support pins 521 into any of the inner support pin adjustment holes 725. In some embodiments 6 holes 725 are provided representing approximately 3 inches of height variation over the 19 inch total height range.

In another embodiment, (not shown) the two spring inner support pins 521 are mounted on a separate adjustment plate located behind and slotted through the vertical support plate 500*b* and are adjustable up and down by operating a thumb screw mounted vertically and pushing down on one of two parallel plate links also located behind the vertical support plate 500*b* that keep the adjustment plate from noticeably rotating. In this particular embodiment, the position of the two spring inner support pins 521 are continuously adjustable in the range of the two positions depicted in FIG. 16 and FIG. 16*a* and within the heights of the two slots located through the vertical support plate 500*b*.

FIG. 16 also shows a different embodiment for the carrier 800, a symmetric clamp carrier where the golf club 40 is placed up through the center of the clamp carrier 800 and can be positioned inside the clamps 820 until the top of the club touches the torsion spring element 640. The clamps 820 for this embodiment are made from thick extrusions instead of formed thin material. The carrier 800 can be extended back on the track 500*a* until one of the wheels 642 makes contact with the slotted spring end support 715 or an adjustable tab 716 that can be positioned anywhere along the track 500*a*. The adjustable tab 716 can be set to limit the backswing and an indication for the golfer to practice proper and consistent distance with the apparatus as well as direction.

Figure 17:
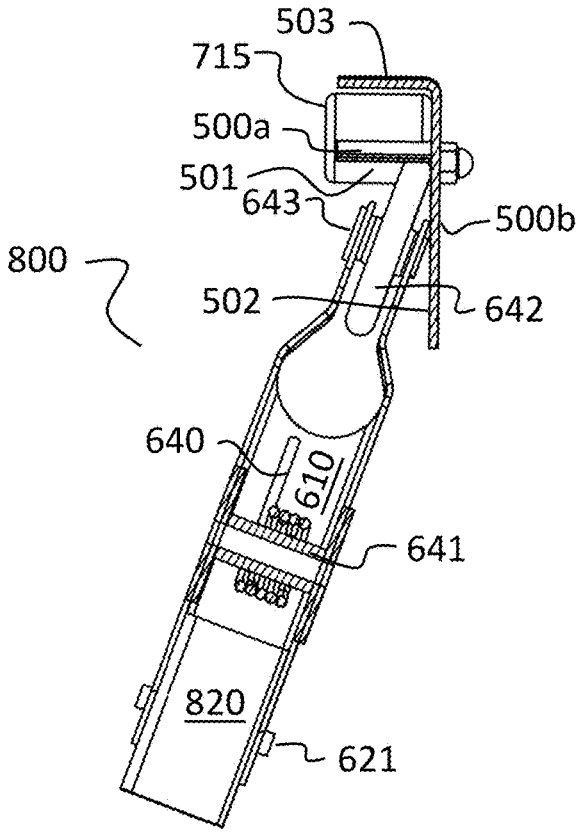
FIGS. 17 and 17*a* are a cross sections of the guide angle and both a cross section view and side view of the symmetric clamp carrier assembly.

FIG. 17 shows a cross section through the symmetric clamp carrier 800 showing the depth of the arms 610 are sufficient for the club handle to be inserted. FIG. 17 also shows the slotted spring end support 715 that supports the end of the leaf spring 500*a*.

Figure 17A:
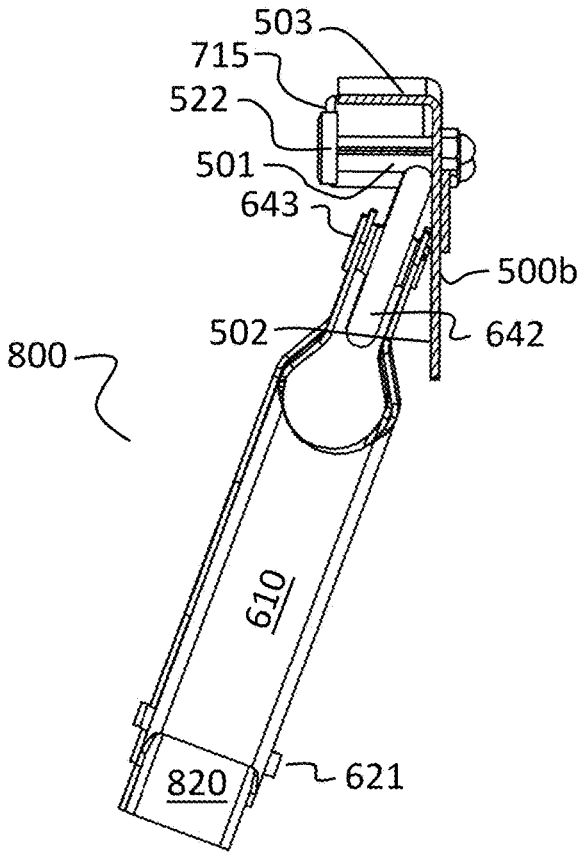

FIG. 17*a* is a side view of the symmetric clamp carrier 800 and clearly shows the surfaces 501 and 502 that engage with the wheel 642 during all angles of contact. The Inner spring support pin 521 and head 522 are also shown in relation with the leaf spring 500*a*.

Figure 18:
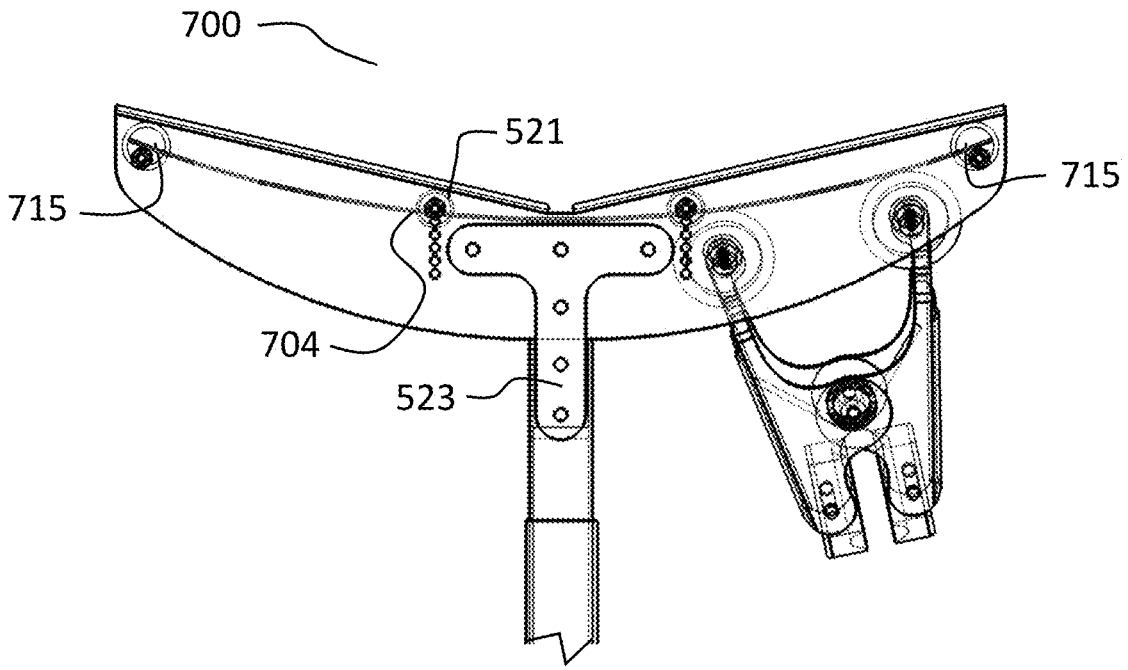
FIG. 18 and FIG. 19 are an enlarged view of the back of the center adjustable golfing guide apparatus and a top view of the center adjustable golfing guide apparatus and a stand assembly.

FIG. 18 is a view of the back of the center adjustable golfing guide apparatus 700. The hidden features are shown by dashed line indicating they are on the other side of the vertical support plate 500*b* or behind the arm 610. The offset stud attaching the slotted spring end support 715 to the vertical support plate 500*b* is evident in this embodiment. The inner support pin adjustment holes 725 are also shown clearly on either side of the splice plate 523. The relative location of the spring steel notches are indicated as well. The straight segment length between end points of the sprung radial leg 500*a* shortens as the radius decreases. In order to retain the spring 500*a* in the shortened position, the size of the slotted spring end support 715 can be increased or the spring can be prevented from moving all to one side or end support 715. A small intent of notch in the profile of the spring 500*a* maintains its alignment at the spring inner support pins 521 by gloving around the head feature or a shoulder feature on the pins 521. As the spring 500*a* shortens the slotted spring end support 715 rotates slightly and because of the offset attachment stud the slot to slot length also shortens slightly. This effect can be more pronounced if the offset distance between the stud and the slot is increased. In order to take advantage of this effect, a oblong shaped slotted spring end support 715 may be necessary.

Figure 19:
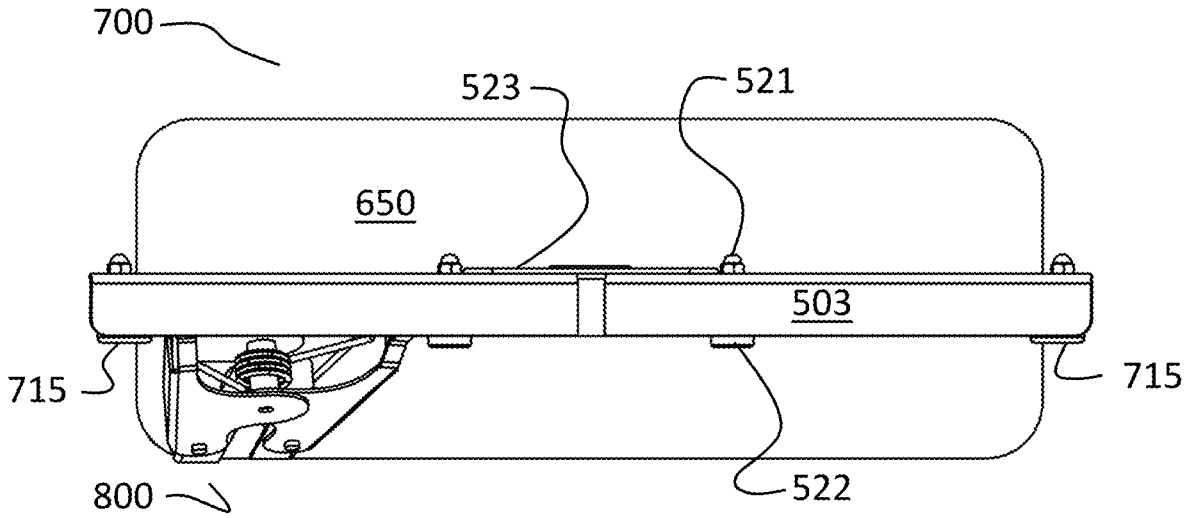

Finally FIG. 19 depicts a top view of the center adjustable golfing guide apparatus 700 and the base plate 650 assembly similar to FIG. 15. In order to adjust the radius of the arc motion, the nuts holding the spring inner support pins 521 must both be relocated.

If the embodiment as shown in FIGS. 12, 13, and 14 depicting an asymmetric clamp carrier is combined with the embodiment as shown in FIGS. 16 and 17 depicting a symmetric clamp carrier, a full range of three relative golf club handle positions may be possible by combining a set of clamps 820 with the set of offset clamps 620 in the same carrier apparatus.

In one embodiment a smooth shallow hooked shaped ledge is provided at the center of the back of the guide angle 500 that allows it to rest on the top of the belt. In order to align the golfer with the stand this hook can be used to temporarily connect the golfer to the apparatus. The golfer can the simply lift the device off the belt to release from the adjustable golfing guide apparatus. This way to easily align the apparatus with the user helps the user with feedback as to detect errant motions that the golfer may have in his swing and can be used to more quickly identify these errant motions without the aid of a bystander or coach.

Furthermore the stand mounted adjustable golfing guide apparatus can be made interchangeable with a belt mounted adjustable golfing guide apparatus by using an adapter piece to transfer between them. The adaptor piece in one embodiment can be made similar to a standard hinge with two leaves and a hinge pin. The first leaf can be integrated with the guide angle assembly and could be an extension of the splice plate 523 or an extension of an adjustable plate member connecting the two spring inner support pins 521. The other leaf would have provisions such as two elongated slots to thread a belt through. The belt 300 would preferably be a stiff thick leather like belt with sufficient rigidity to support the adjustable golfing guide apparatus without excessive movement. Once the second leaf is attached to the front of the belt and centered on the ventral side of the sagittal plane of the user, they could belly up to the stand mounted adjustable golfing guide apparatus and use it with the advantage of the additional support and alignment. The two leaves could then be connecting by aligning the hinge axes of each separate leaf along a single axis and inserting a special hinge pin.

The hinge pin would have a special feature to expand in the hole once inserted to lock the two leaves together and prevent them from relative rotation. A pin with this feature is commonly known as an adjustable diameter pin and sold by companies including Avibank Manufacturing Inc. These pins can be inserted from one end and contain a series of split rings that open when a cam shortens the length of the pin. The golfer can insert such a pin located on a lanyard in some embodiments into the axis of the hinge of both leaves and turn the cam thereby locking the relative rotational degree of freedom between the two leaves. The stand therefore is used to calibrate the position of the vertical plane of any particular user and allow the user to practice their stroke without a stand and relying on their technique to prevent errant body motions such as rotations of the waist.

The stand or pole 530 would be released from the adjustable golfing guide apparatus in one embodiment by using a ball lock quick release pin also sold by Avibank Manufacturing Inc. In one embodiment, the stand is attached to the adjustable golfing guide apparatus with a splice plate 523. The splice plate has two fasteners that connect to the upper pole 531 and these would be good candidates for use of a ball lock quick release pins that can be easily released by the golfer in a putting stance.

Once the adjustable golfing guide apparatus is connected to the belt, additional restraint may be necessary to stabilize the apparatus with the user's waist. A provision to hook a strap to the tips of the guide angle 500 near the end of the leaf spring 500*a* and spanning them back to lateral attach points on the belt 300 in or near the coronal plane would significantly improve the stability of the adjustable golfing guide apparatus.

The initial training method first properly fits the Golf Putting Training Apparatus to the golfer's height, physique and golfing stance. The swing radius is matched within a range of the golfer's height. The first steps properly fit the Golf Putting Training Apparatus, and then use the apparatus to correct any erratic stroke motions to gain a consistent swing. After swing consistency is achieved, the apparatus is used to master repeatable directional accuracy and precision on a flat surface. Next, putting distance is matched to the amount of back swing and calibrated. And finally, the technique is extended to a contoured putting green where the break must be anticipated and compensated for. These steps are:

Step 1: Properly match the size of the Golf Putting Training Apparatus with the golfer's height, physique and putting or chipping stance. The stance angle can be observed and measured and the radius adjusted accordingly by switching out sizes. A more upright stance and taller height requires a larger size apparatus with a larger swing radius.

Step 2: Align the back surface 102 of guide angle 100 to a vertical plane 21 by custom fitting a conformal pad 110 or adjusting the angle 30 $\alpha$ the position of the belt face with the plane normal to the ground plane 21.

Step 3: Attach top of golf club 40 with club handle adapter 203 and let arms hang freely down from shoulders and grip the golf club handle as if addressing the golf ball with eyes directly over the position of the golf ball.

Step 4: Loosen any adjustment features including 1) extension of carrier block throat 202 that changes length of carrier block; 2) angular adjustment joint 202*a* that adjust angle $\beta$ 50 between club shaft and carrier block 200.

Step 5: Seat bearing interface surfaces of carrier block 200 with guide angle 100 including carrier block slip surface 201 with curved radial surface 101 and carrier block vertical slip surface 201*a* with back surface 102. Tighten adjustment features to retain them in proper position.

Step 6: Starting with a level putting surface such as a floor, address golf ball in the putting stance and align straight angle guide 100 with intended direction of ball 60 toward a target. Apply enough pressure up through the golf shaft to trap the carrier block 200 firmly against the angle guide 100 during all portions of the swing. Concentrate on holding hips in position by keeping angle guide 100 pointed to intended direction while winding upper body into the backswing. Initiate swing while wrists are locked by unwinding upper body through the intended direction of ball 60 toward the target.

Step 7: Repeat swing until body is able to go through motion with only light force required to trap the carrier block 200 firmly against the angle guide 100 during all portions of the swing and the ball's trajectory is consistently toward the target.

Step 8: Continuing with a level putting surface such as a floor, work on putting distance by placing a reference mark on the angle guide 100 and carrier block 200 to denote the stop or pause point of the backswing. Concentrate on bringing the backswing to this point then proceeding with forward swing and note distance ball is traveling. Once the ball is traveling consistently to a given distance, make another mark on the angle guide 100, either extending or contracting backswing to increase or reduce ball travel distance. Practice consistently putting the ball to longer and shorter distances. In some implementations, marking the angle guide may include a clip that is attached to the angle guide at any point along the carrier block path to serve as a stop for the carrier block. Alternately, the guide angle may include a series of small apertures whereby a pin or post may be inserted to serve as a stop. In this way, the arc length of the swing may be adjusted according to the observed travel distance of the ball.

Step 9: Next address putting stance on an actual putting green. Anticipate any break in a contoured putting green by compensating the intended direction of ball 60 slightly left or right of the cup target. Repeat swing concentrating on maintaining the alignment of guide angle with the adjusted target. It may help to place a coin or similar flat object at the exact spot that is aimed. It may also help to have a spotter or golf trainer verify that the direction of angle guide 100 remains fixed on intended target through all portions of the swing. The golf training apparatus is useful in this mode to help a trainer assess a golfer's swing for directional accuracy and precision.

Step 10: Next continue to address putting stance on an actual putting green. Using the marks placed on the angle guide 100 in Step 8 anticipate whether the putt is up hill and adjust putt to a longer stop position to compensate. After gaining confidence for slightly uphill putts, try slightly downhill putts shortening stroke accordingly. It may also help to have a spotter or golf trainer verify that the extent of backswing remains fixed and doesn't go past the intended mark. The golf training apparatus is useful in this mode to help a trainer assess a golfer's swing for distance.

Step 11: Next combine controlling trajectory break with distance on an actual putting green while simulating play. In some embodiments, the angle guide 100 is easily released and removed from the golfer's belt while maintaining proper alignment and fit. That way the golfer can engage in tee offs and approaches to green and incorporate the chipping and putting skills learned from using the Gold Training Apparatus with all aspects of the game.

The embodiment shown in FIG. 10 uses a stand mounted adjustable golf training apparatus 400. In this embodiment the vertical leg of the guide 410 is mounted on a telescoping stand 450. The ideal swing radius 11 of the curved radial surface 101 would vary with the height of the golfer. Because of proportionate arm and torso lengths, a short golfer would swing along a smaller swing radius 11 and a taller golfer a larger swing radius 11. In some embodiments, the swing radius 11 for an adult golfer would be between 18 and 27 inches depending on their height, uprightness of stance, and relative lengths of arm and torso to their height. For other embodiments, a child's apparatus may have a swing radius 11 shorter than 18 inches depending on their bodies' relative proportions of torso, and length of arms. The disclosure herein refers to a swing radius or radial arc segment, and in other embodiments, other types of curve segments may be used and approximated such as an elliptical arc, and other portions of a parabolic, trigonomial, or other polynomial curve of various degrees can also be used to guide the motion of the hands and wrists through the golf swing.

Step 1: Adjust training aid to golfer's physique: Adjust the guide radius to the match the golfer's height. Clamp carrier to the handle of golf club. Straddle the stand supporting the guide and adjust the guide height to matching the belt buckle to the back of guide or to a comfortable position.

Step 2: Align club with the intended line of action: Take a comfortable stance holding the golf club handle and pull the carrier up into the angle guide lightly to check how the club is positioned relative to the ball. Make any adjustments to the carrier to keep the club face aligned perpendicular to intended path and provide the right address of the ball. Choose an initial line of action with little or no anticipated break.

Step 3: Verify the intended line of action: Leaving the club touching the ground and with the carrier engaged with the angle guide in the neutral position, step aside and check the alignment of the putter with the intended line of action. Return to straddle the stand and engage club handle taking a few practice swings to get a feel for the mechanic and degrees of freedom that are frozen.

Step 4: Associate length of backswing to putting distance: Set the back swing stop adjustment tab 716 if distance is part of the training focus. Take a normal swing concentrating on a rigid body motion between arms and shoulders about an axis nearly aligned with spine and allowing the backswing to bump into adjustment tab 716.

Step 5: Repeatability and Feedback: After repeating the stroke a number of times and assessing the alignment of the path of the ball and the distance, rest the back guide hook on the top of waist belt and repeat paying attention to any feedback through the connection.

Step 6: Check consistency with decreased constraint: Using the guide pole to align the golfing guide apparatus with the vertical plane, transfer the apparatus to the belt by releasing apparatus from pole and engaging hinge leaves with motion restricting connection. Repeat stroke using belt to access whether the alignment and distance is maintained or is degraded. If any degradation or inconsistency is observed return apparatus to the pole after releasing from belt paying attention to subtle differences in swing between the pole and belt. Separate the focus on alignment and distance and concentrate on each aspect of putt or chip.

What is claimed is:

1. A golf putting training apparatus comprising:

a guide member including a curved first bearing surface and a planar second bearing surface;

a movable member with a club handle holding portion including:

a proximal portion configured for slidable translation over the first bearing surface, and a distal portion configured to couple with a putter handle;

an angle defined transversely relative to the planar second bearing surface and the club handle holding portion of the movable member, wherein the angle is adjustable by a user throughout an arcing movement of the movable member;

a freestanding platform configured to support the guide member.

2. The guide member according to claim 1, the planar second bearing surface is adjacent to the first bearing surface.

3. The apparatus according to claim 1, wherein a radius of the first bearing surface is flexibly adjustable.

4. The apparatus according to claim 1, the guide member detachable from the freestanding platform.

5. The apparatus according to claim 1, the movable member separable from the first bearing surface during translation along the first bearing surface.

* * * * *